US012765686B2

(12) United States Patent
Dewert

(10) Patent No.: US 12,765,686 B2
(45) Date of Patent: Oct. 20, 2026

(54) ELECTROMOTIVE DOUBLE DRIVE

(71) Applicant: Pampero AG, Pfäffikon (CH)

(72) Inventor: Eckhart Dewert, Eschenbach (CH)

(73) Assignee: Pampero AG, Pfaffikon (CH)

( * ) Notice: Subject to any disclaimer, the term of this patent is extended or adjusted under 35 U.S.C. 154(b) by 0 days.

(21) Appl. No.: 18/654,783

(22) Filed: May 3, 2024

(65) Prior Publication Data

US 2024/0365990 A1 Nov. 7, 2024

(30) Foreign Application Priority Data

May 5, 2023 (DE) ..... 102023111804.8

(51) Int. Cl.
*A47C 20/04* (2006.01)

(52) U.S. Cl.
CPC ..... *A47C 20/041* (2013.01)

(58) Field of Classification Search
CPC ..... A47C 20/041; A47C 20/08; A47C 7/002; A47C 7/24; A47C 17/86; A47C 19/021
See application file for complete search history.

(56) References Cited

U.S. PATENT DOCUMENTS 5,063,623 A * 11/1991 Bathrick ..... A61G 7/015 5/616
7,404,603 B2 * 7/2008 Dewert ..... A47C 1/0242 297/331
2017/0332798 A1 * 11/2017 Dewert ..... A47C 20/041
2017/0332799 A1 * 11/2017 Dewert ..... A47C 20/041
2017/0332800 A1 * 11/2017 Dewert ..... A47C 17/1756
2018/0125251 A1 * 5/2018 Dewert ..... A47C 20/041

FOREIGN PATENT DOCUMENTS

DE 102020131204 A1 6/2021
DE 102020131206 A1 6/2021

* cited by examiner

*Primary Examiner* — Ictor L Macarthur
(74) *Attorney, Agent, or Firm* — Fresh IP PLC; Terrence L.B. Brown

(57) ABSTRACT

An electromotive double drive 2 for adjusting pivotally adjustable support parts of a support device for supporting a cushioning of a seating and/or lying furniture, in particular a mattress of a box-spring bed, relative to one another comprises a base body 4, at which two drive units 6, 8 are arranged, each comprising a drive member 10 or 12 respectively. The double drive 2 further comprises two pivot levers 18, 20 spaced apart from one another in longitudinal direction of the base body 4 and each pivotably disposed at the base body around a pivot axis 14 or 16 respectively, wherein the pivot levers 18, 20 are respectively in operative connection with the output member 10, 12 of an associated drive unit 6, 8 for pivoting the respective pivot lever 18, 20 relative to the base body 4. The base body 4 comprises two supporting and fixing structures 30, 32 spaced apart from one another in its longitudinal direction for supporting and fixing the base body 4 at transverse cross-members 38, 40, wherein each supporting and fixing structure 30, 32 comprises a support surface 34 or 36, respectively, for resting at a transverse cross-member 38, 40. According to the invention, the support surfaces 34, 36 are arranged in longitudinal direction of the base body at the height of the pivot axes 14, 16 in such a way that, in the mounting position of the double drive 2, the pivot axes 14, 16 lie in vertical direction via the respective associated support surface 34 or 36.

10 Claims, 11 Drawing Sheets

ELECTROMOTIVE DOUBLE DRIVE

Figure 1A:
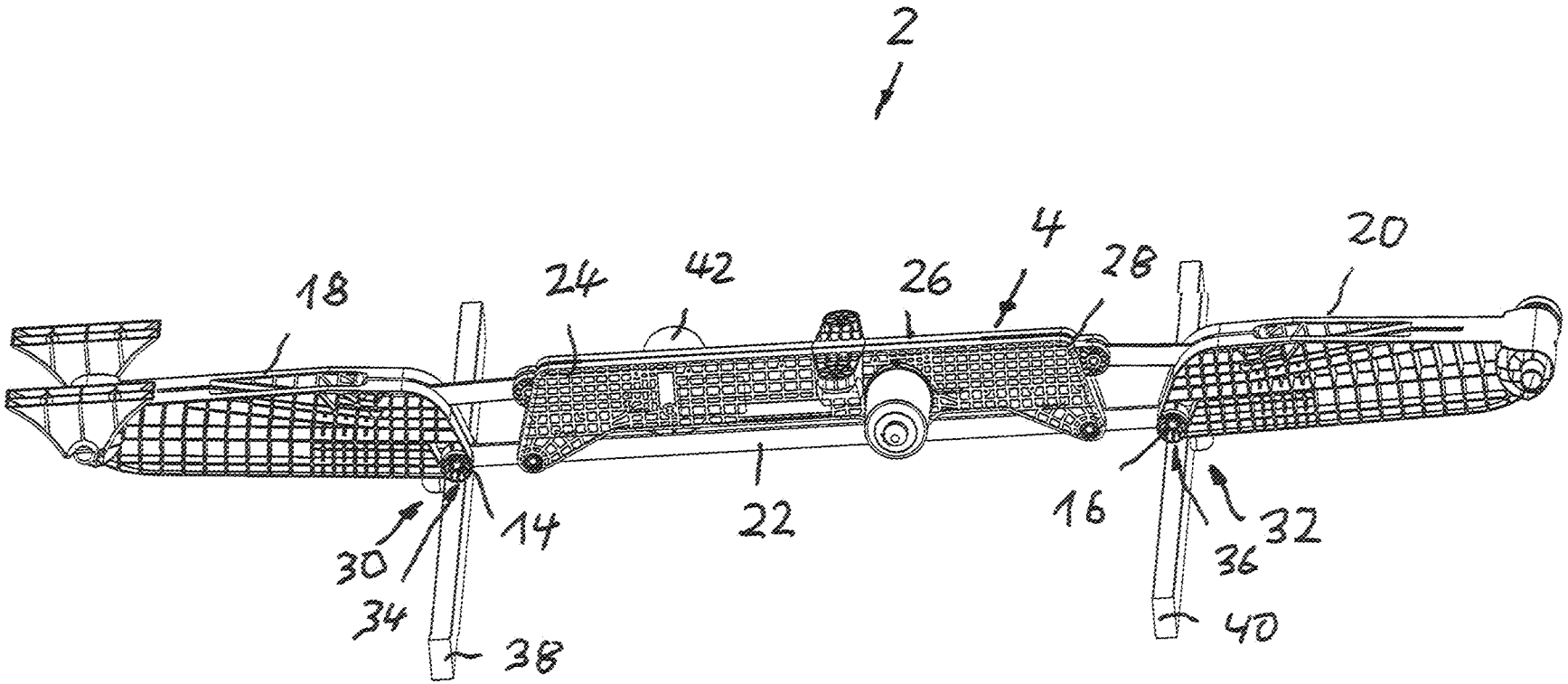

The invention relates to an electromotive double drive of the type mentioned in the preamble of claim 1 for adjusting support parts, which can be moveably pivoted relative to one another, of a support device for supporting a cushioning of a seating and/or lying furniture, in particular a mattress of a box-spring bed, relative to one another.

An electromotive double drive of the manner in question is known from DE 10 2016 116 256 A1 as a furniture drive and comprises a base body, at which two drive units are arranged, each comprising a respective output member. The double drive further comprises two pivot levers spaced apart from each other in longitudinal direction of the base body and each pivotably disposed at the base body around a pivot axis, wherein each of the pivot levers is respectively in operative connection with the output member of an associated drive unit for pivoting the pivot lever relative to the base body. For mounting the double drive at a bed base, for example, the base body comprises two supporting and fixing structures spaced apart from one another in its longitudinal direction for supporting and fixing the base body at transverse cross-members, wherein each supporting and fixing structure comprises a support surface for resting at a transverse cross-member.

The double drive as known comprises a longitudinal cross-member made of metal supporting a drive housing, in which the drive units are accommodated and at which the pivot levers are disposed pivotally adjustably. The supporting and fixing structures are arranged at the ends of the longitudinal cross-member. To assemble the double drive, the base body with the supporting and fixing structures is arranged at transverse cross-members, which are arranged at the ends of a bed base, for example a bed stead or bed frame. The base body is then fixed to the transverse cross-members via the supporting and fixing structures, for example by screwing.

The double drive known from the publication has a simple and robust design and is also characterised by simple assembly.

The problem underlying the invention is to further improve a double drive of the type mentioned in the preamble of claim 1.

This problem is solved by the invention specified in claim 1.

The invention provides that the bearing surfaces are arranged in longitudinal direction of the base body at the height of the pivot axes in such a way that, in the mounting position of the double drive, the pivot axes are located in vertical direction via the respective associated bearing surface.

The invention refers to the idea of fixing the base body to the ends of a bed base or bed frame. Rather, it is based on the idea of shortening the base body in longitudinal direction of the double drive and thus in longitudinal direction of the bed and designing the structure in such a way that, in the mounting position of the double drive, the transverse cross-members are arranged below the respective pivot axis respectively. The corresponding arrangement means that the double drive is fixed to transverse cross-members that are arranged at a distance from the ends of the bed base in longitudinal direction.

The corresponding arrangement is that, in the mounting position, the distance between the fixing points, at which the base body is fixed, is shortened in longitudinal direction of the bed base. Accordingly, the base body of the double drive can be formed shorter than the known double drive. This makes the constructive design of a double drive according to the invention simpler and more cost-effective.

The double drive according to the invention has a further advantage in that it provides an increased stability against bending loads in particular due to the shortening of the base body.

The transverse cross-members, to which the double drive according to the invention is fixed via the supporting and fixing structures, can be part of a bed base. The double drive is then arranged with its supporting and fixing structures at the transverse cross-members, which are spaced apart from each other in longitudinal direction of the bed base, and fixed to these. However, it is also possible that the transverse cross-members are part of the double drive or pre-assembled at it. In a corresponding embodiment, the transverse cross-members provided or pre-assembled at the double drive are then installed in the bed base or fixed to it in order to assemble the double drive.

The constructive design of the base body can be designed in various manners correspondingly to the respective requirements and conditions. In terms of a particularly simple, robust and cost-effective structure, an advantageous further development according to the invention provides that the base body comprises a longitudinal cross-member, preferably made of metal, to which at least one drive housing to accommodate at least one drive unit is fixed and at which the pivot levers are pivotably disposed. In this embodiment, the reaction forces of the drive units are transferred away via the drive housing and the longitudinal cross-member.

The base body of the double drive according to the invention can be divided in longitudinal direction into individual base body parts, which are connected to each other during assembly of the double drive and then form the base body in succession in longitudinal direction of the double drive or of a support device provided with the double drive. In a corresponding embodiment, the drive units of the double drive can be accommodated in separate drive housings. In terms of a simple structure, in particular in the case of a base body that is continuous in longitudinal direction, i.e. not divided, an advantageous further development according to the invention provides that the drive units are accommodated in a common drive housing.

The supporting and fixing structures of the double drive according to the invention can be designed in different manners correspondingly to the respective requirements and conditions, in particular with regard to their material and shape. An advantageous further development according to the invention provides in this respect that at least one supporting and fixing structure is formed as an angle piece, one leg of which forms the support surface and the other leg of which forms or supports a fixing plate for fixing to the associated transverse cross-member. In this embodiment, one leg of the angle piece forms the support surface for resting at the associated transverse cross-member, while the other leg is used for fixing, for example for screwing to the transverse cross-member.

In an advantageous further development of the aforementioned embodiment, the angle piece is formed as metal part. Corresponding angle pieces, for example made of sheet metal, are easy and inexpensive to manufacture and are robust.

Another advantageous further development according to the invention provides, in the sense of a further reduction in the number of components of the double drive, that at least one supporting and fixing structure is moulded at the base body. A corresponding embodiment is provided in particular when the drive housing is made of plastic, as provided in another advantageous further development.

An electromotively adjustable support device according to the invention for supporting a cushioning of a seating and/or lying furniture, in particular a mattress of a box-spring bed, which comprises support parts, which are pivotally adjustable relative to one another for supporting a cushioning, is specified in claim 8. The support device according to the invention is provided with at least one double drive according to the invention.

A seating and/or lying furniture according to the invention, in particular a box-spring bed, is specified in claim 9 and comprises a support device, which is electromotively adjustable according to the invention.

The invention is explained in more detail below with reference to the attached, highly schematised drawing with reference to embodiments. It is apparent to the skilled person that the individual features of an embodiment respectively further develop the embodiment on their own, i.e. independently of the further features. It is thus also apparent to the skilled person that all the features described, shown in the drawing and claimed in the claims form the subject matter according to the invention in themselves and in any technically meaningful combination with one another, irrespective of their summary in the claims and their dependencies and irrespective of their specific description or representation in the drawing. The subject matter and disclosed content of the present application also include combinations of features of one embodiment with features of at least one other embodiment. The subject matter and disclosed content of the present application also include sub-combinations of the claims, in which at least one feature of a claim is omitted or replaced by another feature.

IT SHOWS IN

Figure 1B:
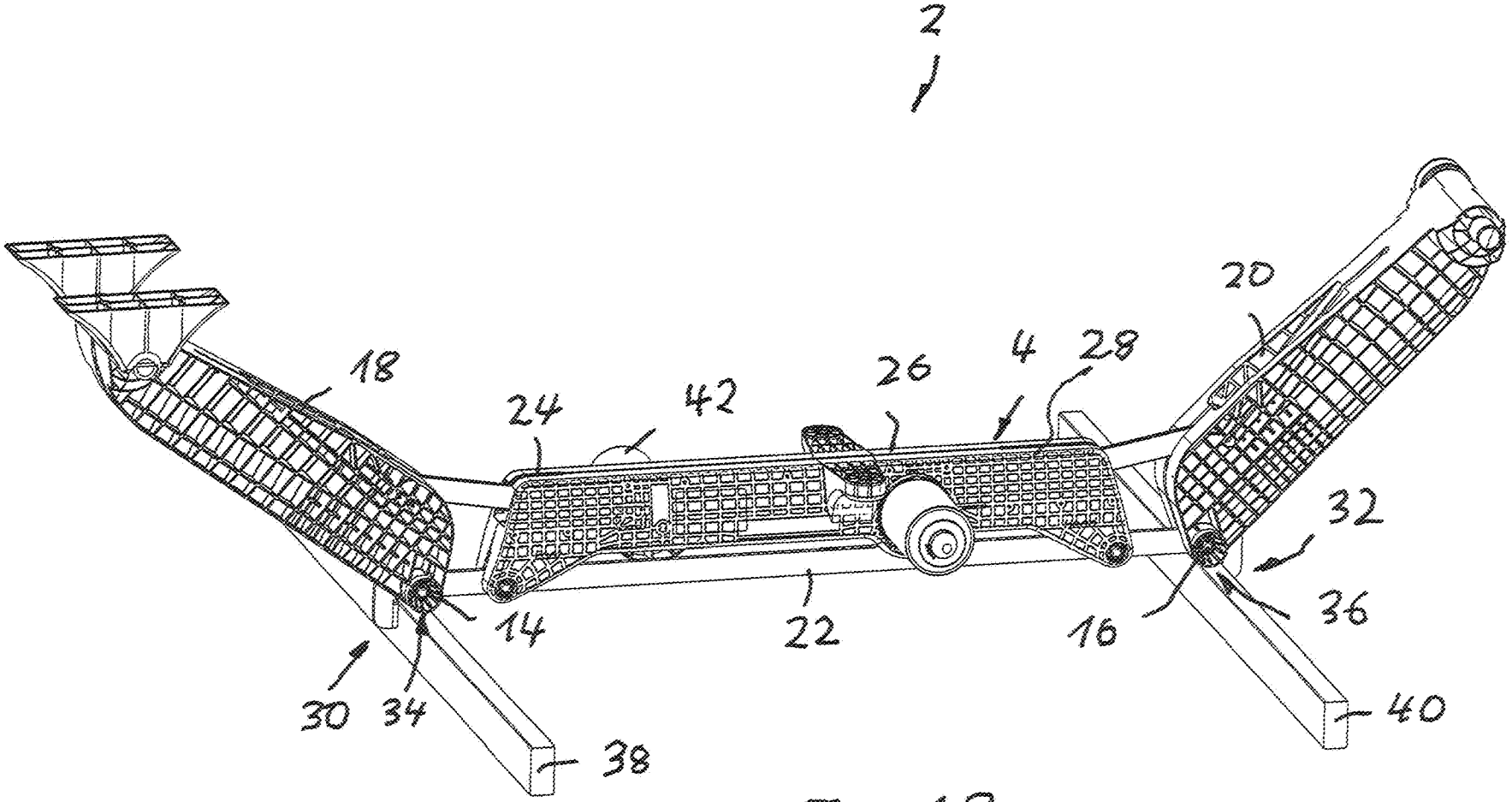
Figure 2:
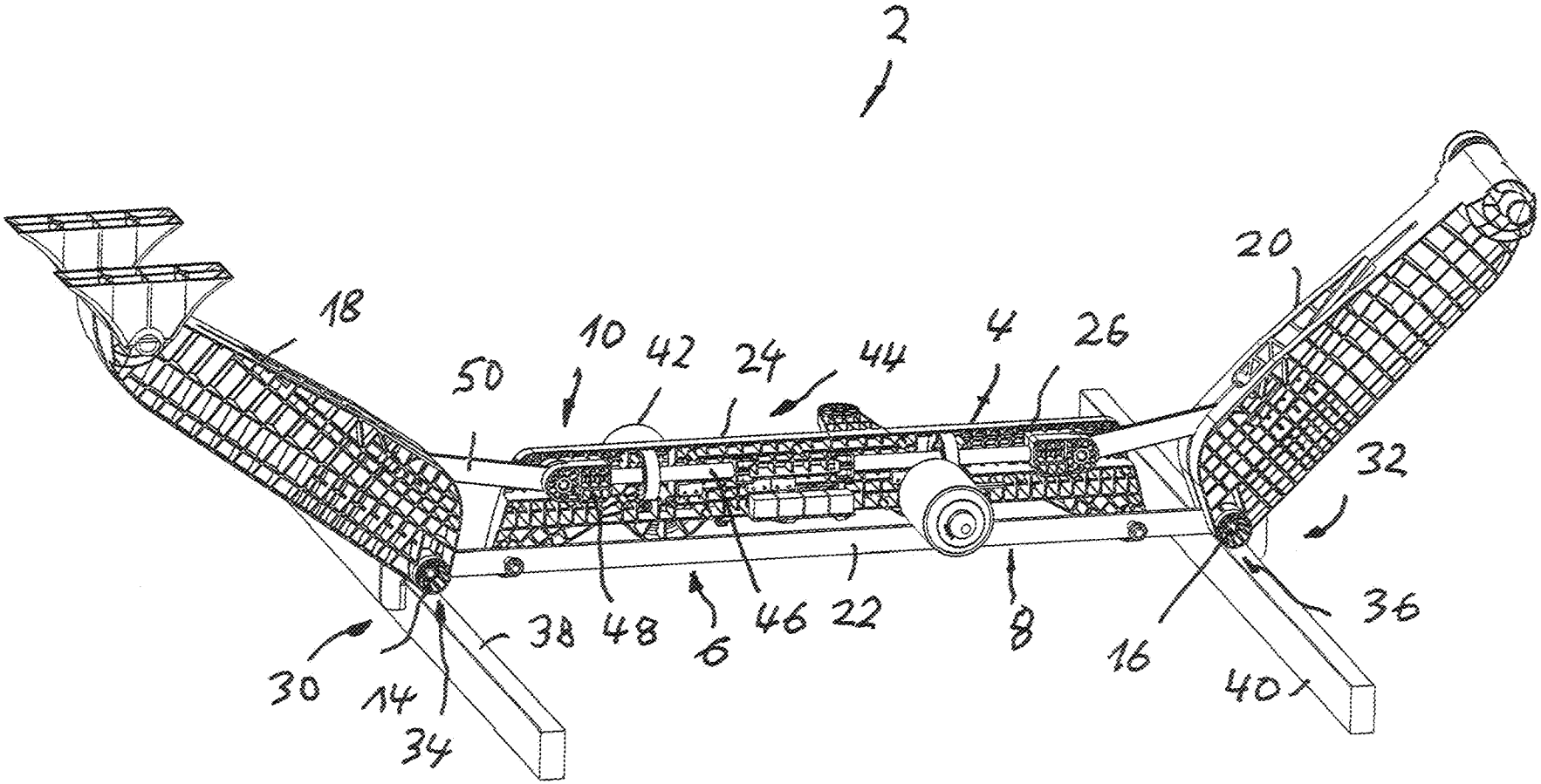
Figure 3:
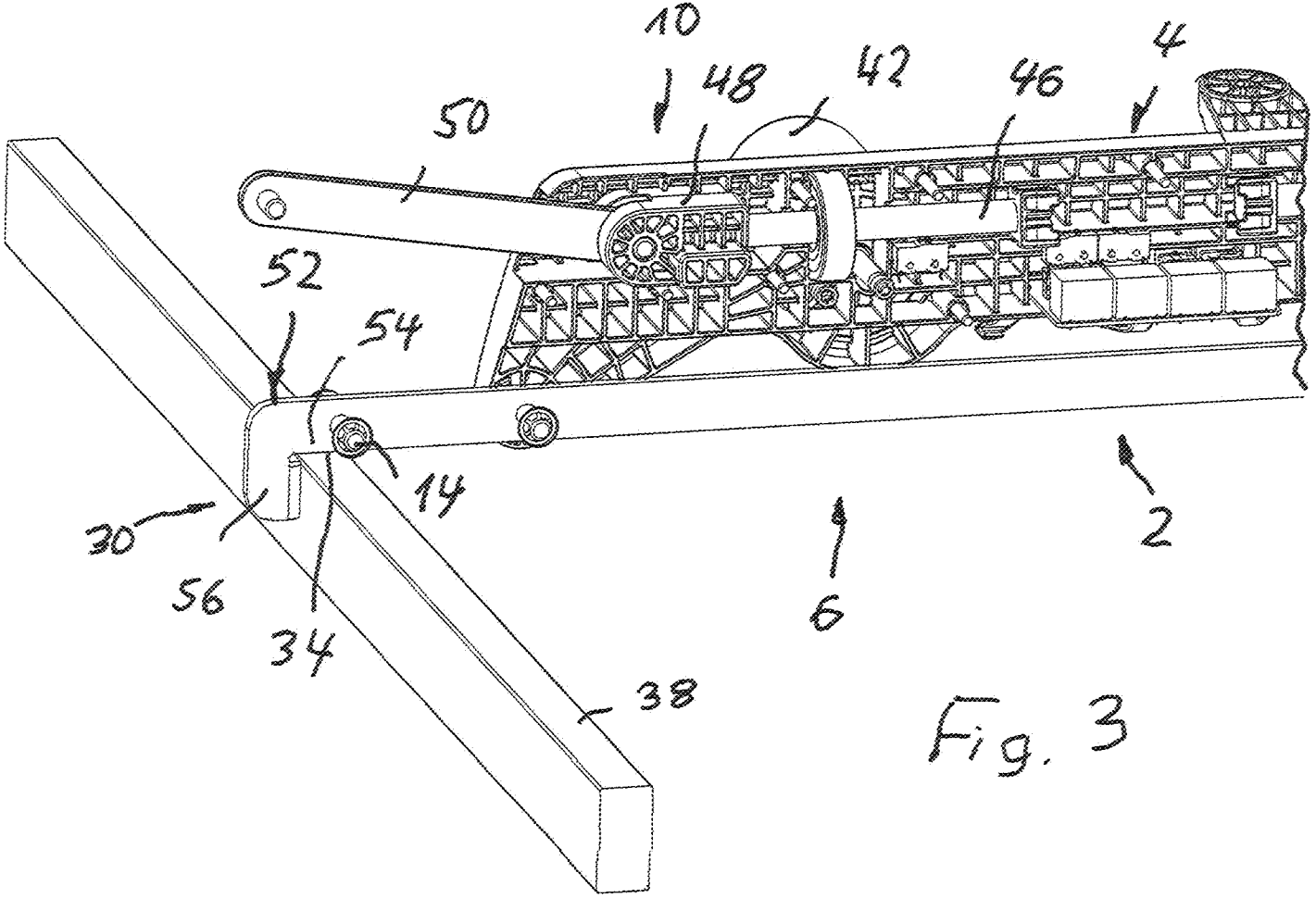
Figure 4:
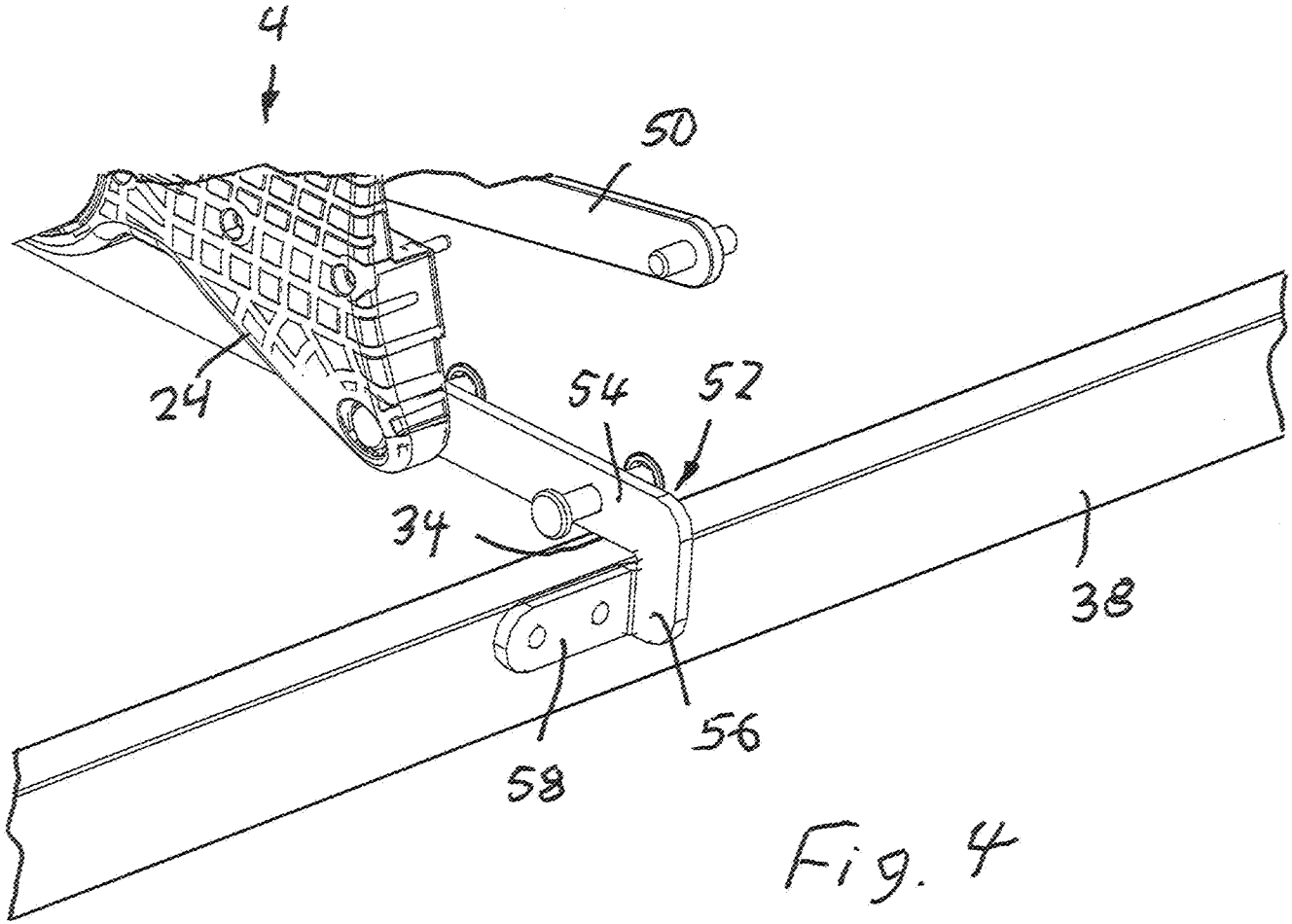
Figure 5:
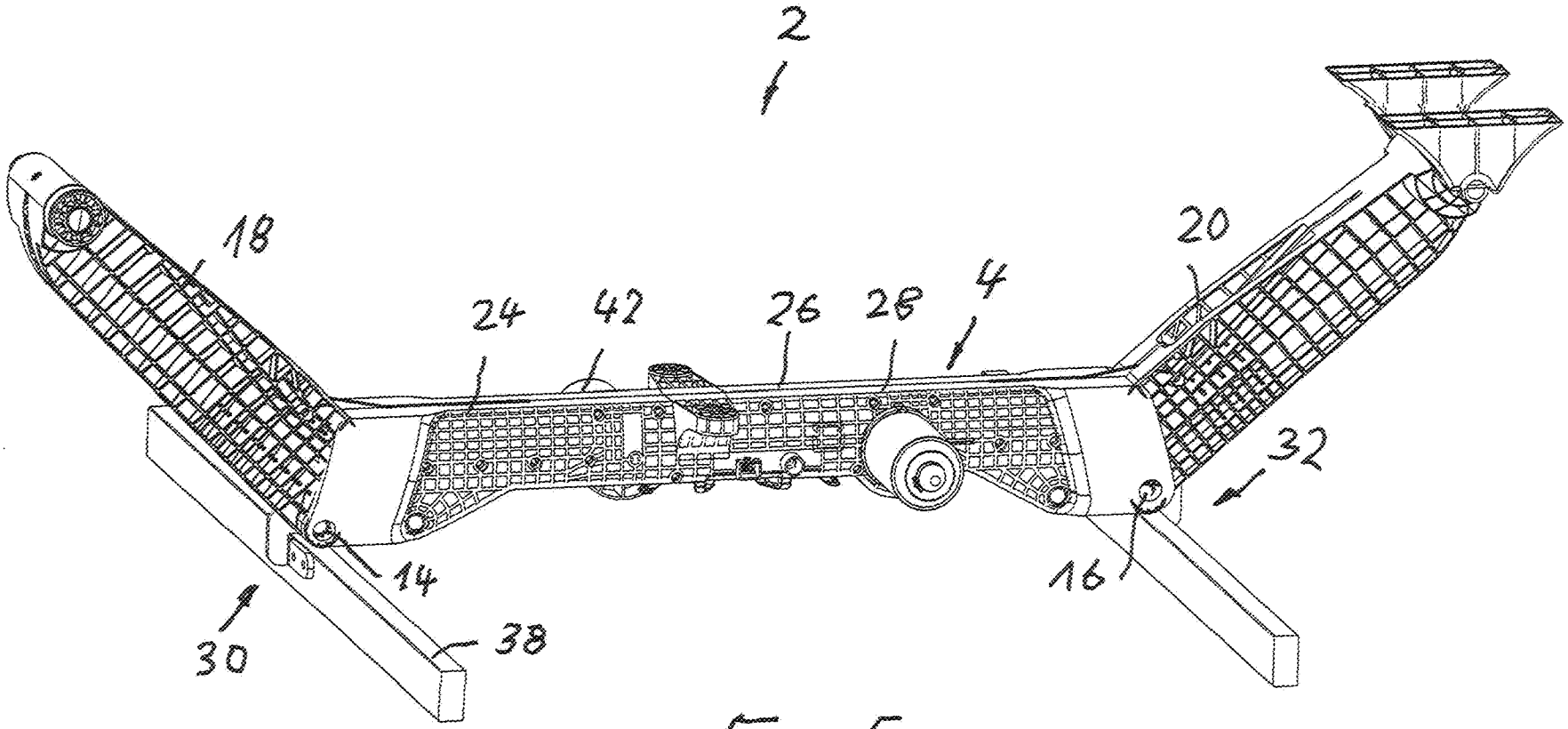
Figure 6:
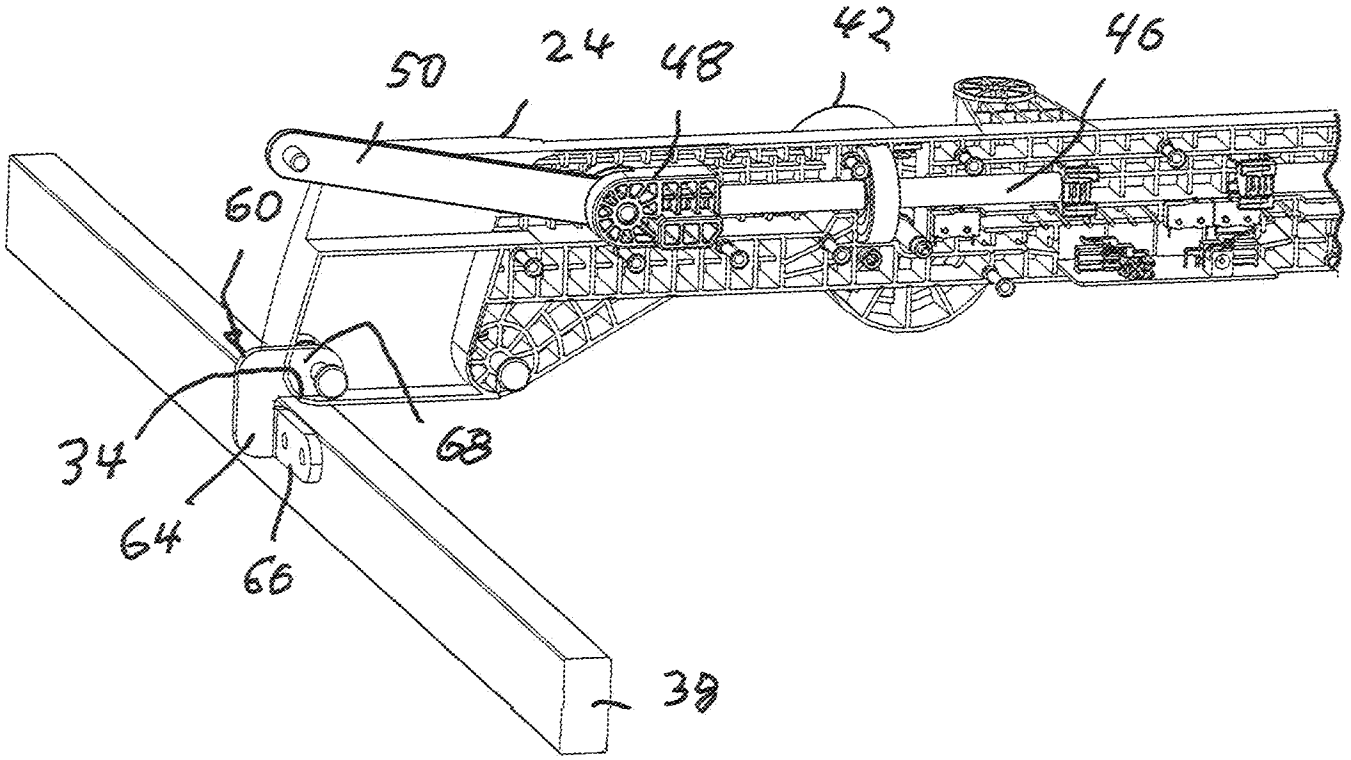
Figure 7:
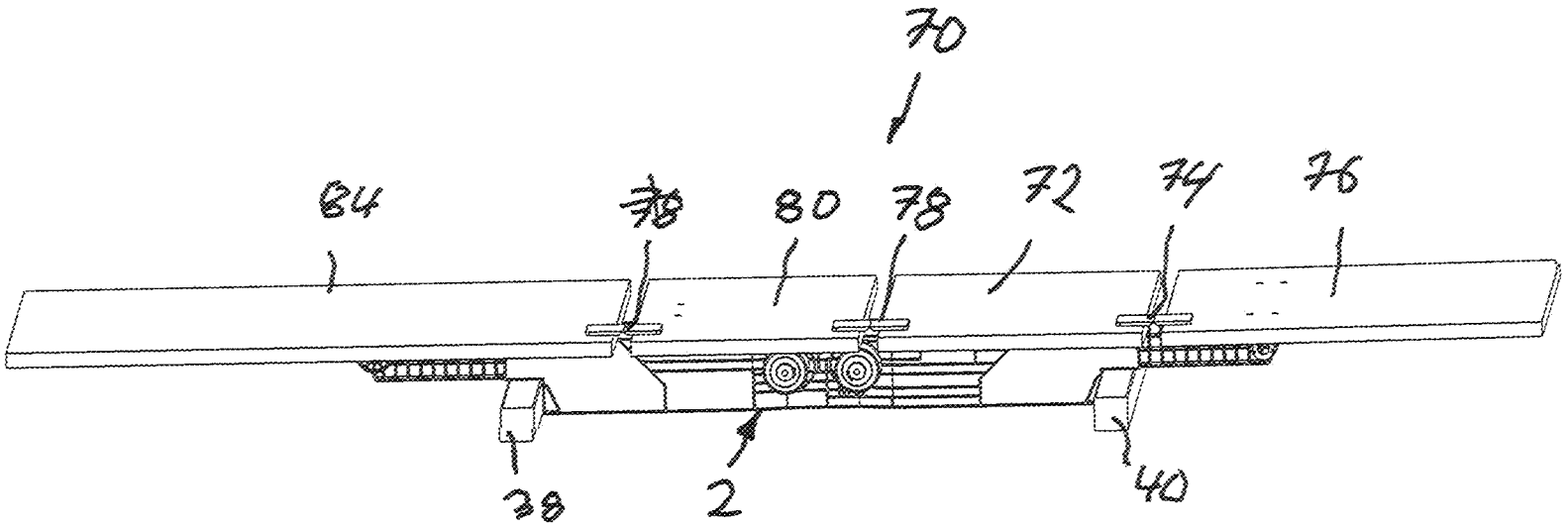
Figure 8:
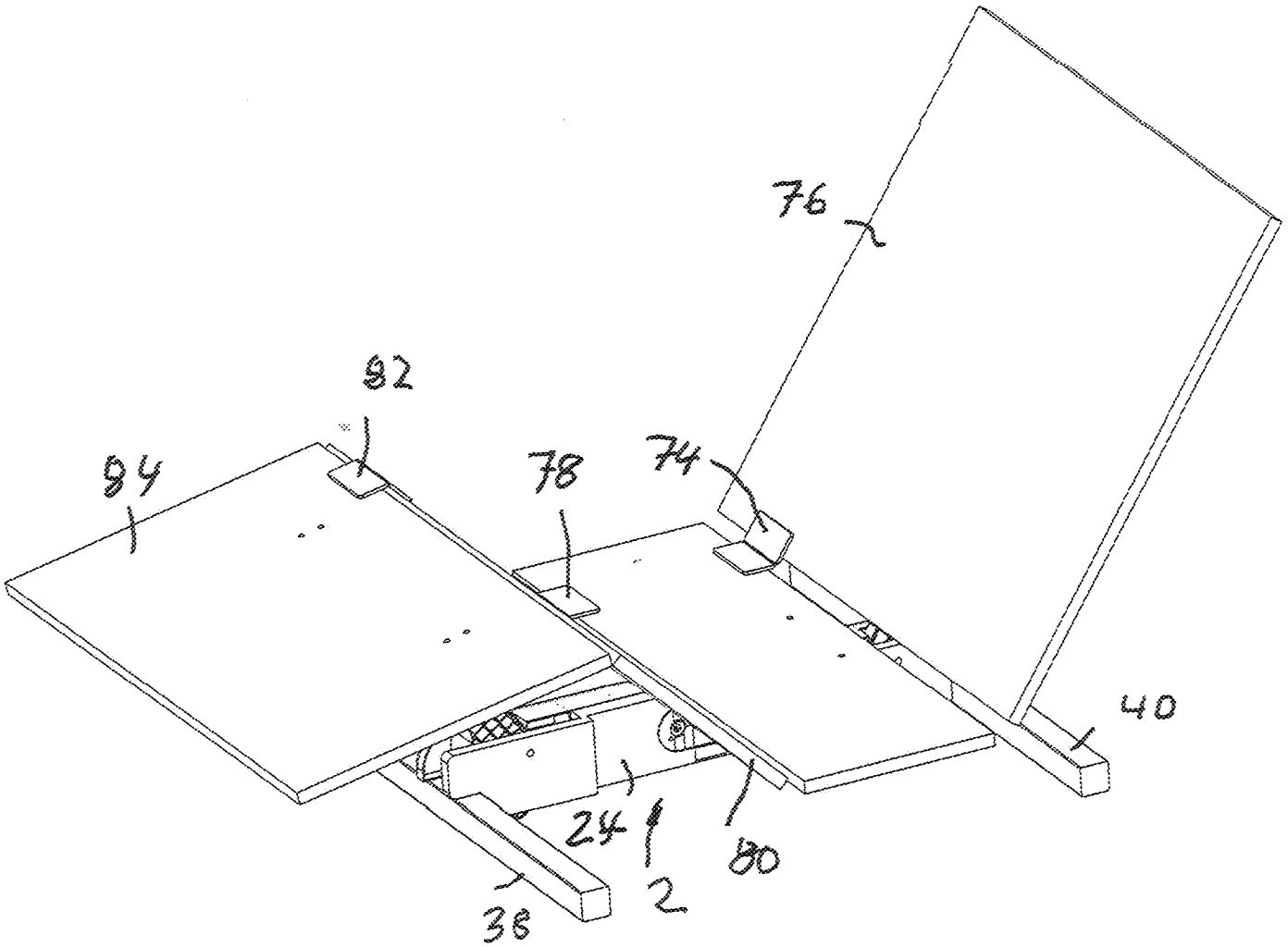
Figure 9:
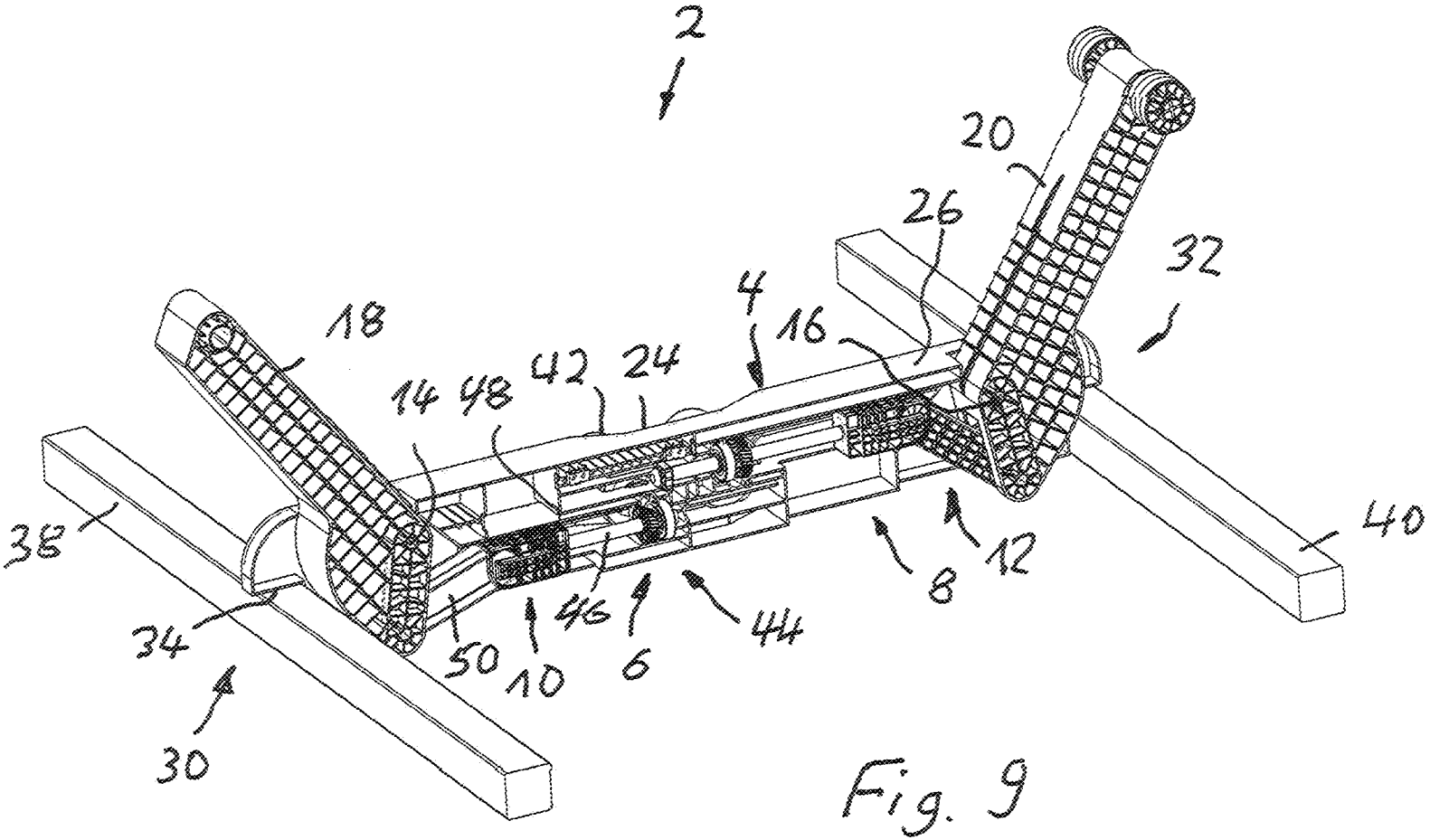
Figure 10:
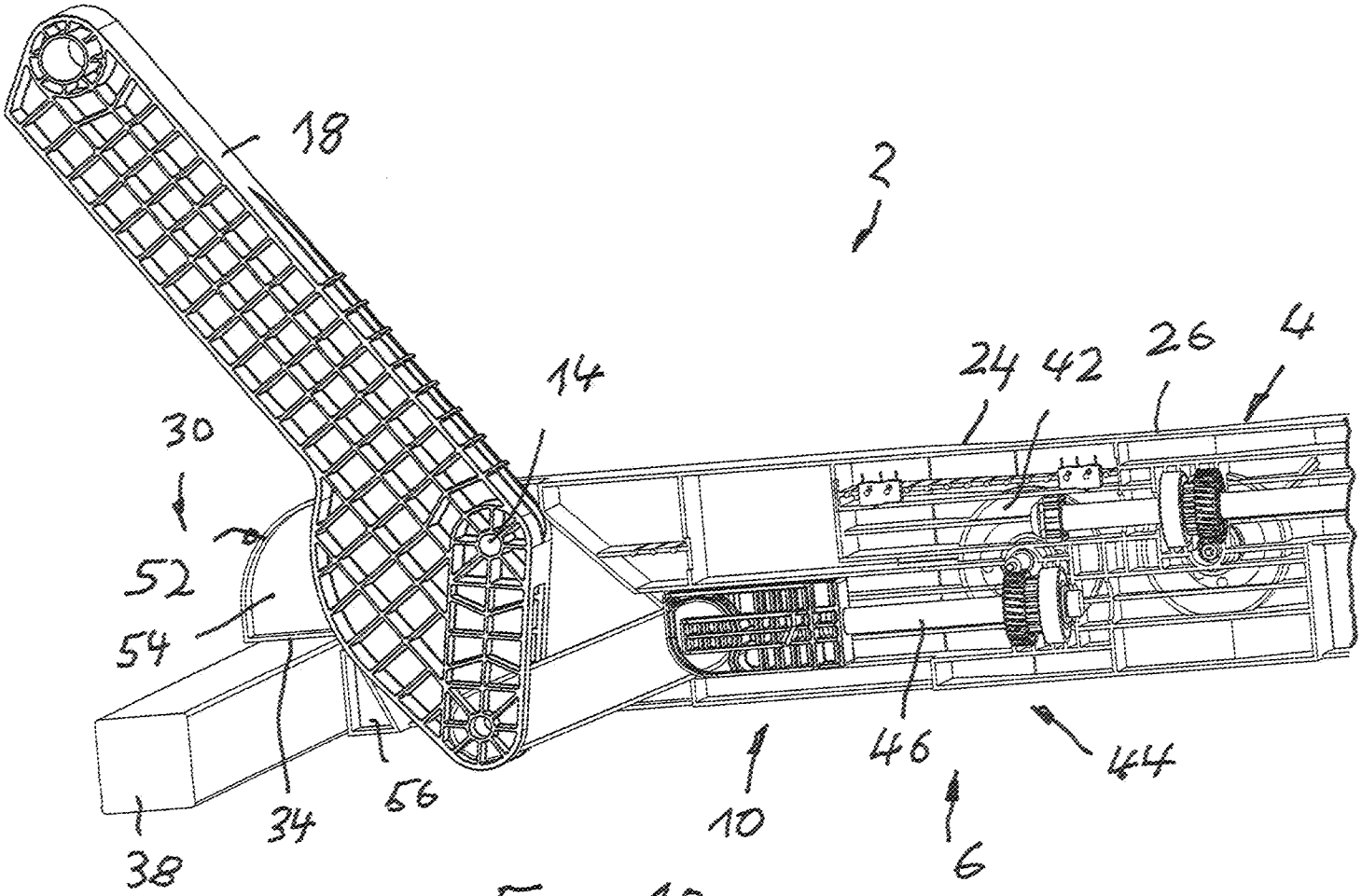

FIG. 1A in a schematic perspective view, a first embodiment of a double drive according to the invention in a starting position of the adjustment movement, FIG. 1B in the same representation as FIG. 1A, the embodiment according to FIG. 1A in an end position of the adjustment movement, FIG. 2 in the same representation as FIG. 1B, the embodiment according to FIG. 1B, wherein a half-shell of a drive housing is omitted to clarify the structure of the drive units of the double drive, FIG. 3 in the same representation as FIG. 2, but on a scale enlarged from FIG. 2, a detail from FIG. 2, wherein a pivot lever is omitted for reasons of illustration, FIG. 4 in the same representation as FIG. 3, but from a different perspective the detail according to FIG. 3, FIG. 5 in the same representation as FIG. 1B, a second embodiment of a double drive according to the invention in a starting position of the adjustment movement, FIG. 6 in the same representation as FIG. 5, but on a scale enlarged from FIG. 5, a detail from FIG. 5, FIG. 7 in the same representation as FIG. 1A, a third embodiment of a double drive according to the invention in a starting position of the adjusting movement, FIG. 8 in the same representation as FIG. 7, the embodiment according to FIG. 7 in an end position of the adjusting movement, FIG. 9 in the same representation as FIG. 8, the embodiment according to FIG. 8, wherein plate-shaped support parts and a half-shell of a drive housing are omitted for reasons of illustration, and FIG. 10 in the same representation as FIG. 9, but on a scale enlarged from FIG. 9, a detail from FIG. 9.

Embodiments of a double drive according to the invention as furniture drive are explained in more detail below with reference to FIG. 1 to FIG. 10. For reasons of illustration, components of the double drive according to the invention are omitted in individual figures of the drawing. The omitted components are to be supplemented in the relevant figures accordingly.

In the figures of the drawing, identical or corresponding components are provided with the same reference signs.

FIG. 1A shows an embodiment of an electromotive double drive 2 according to the invention as furniture drive, which, in the embodiment shown, is used to adjust support parts of a support device that are pivotally adjustable relative to each other to support a box-spring mattress. The basic structure of a corresponding double drive is known from DE 10 2016 116 256 A1 and is therefore only explained in more detail here to the extent that it is necessary for understanding the invention.

The structure of a corresponding support device is also known from DE 10 2016 116 256 A1 and is therefore not explained in more detail here.

The double drive 2 comprises a base body 4, at which two drive units 6, 8 (see FIG. 2) are arranged, each comprising an output member 10 or 12 respectively.

The double drive 2 further comprises two pivot levers 18, 20 spaced apart from one another in longitudinal direction of the base body 4 and each pivotably disposed at the base body 4 around a pivot axis 14, 16, wherein the pivot levers 18, 20 are respectively operatively connected with the output member 10 or 12 of an associated drive unit 6 or 8 for pivoting the respective pivot lever 18, 20 relative to the base body 4.

In the embodiment shown in FIG. 1A, the base body 4 comprises a longitudinal cross-member 22 made of metal, to which a common drive housing 24 to accommodate the drive units 6, 8 is fixed and at which the pivot levers 18, 20 are pivotably disposed.

In the embodiment shown, the drive housing 24 consists of two plastic half-shells 26, 28.

The base body 4 comprises two supporting and fixing structures 30, 32 spaced apart from one another in its longitudinal direction for supporting and fixing the base body 4 at transverse cross-members, wherein each supporting and fixing structure comprises a support surface 34 or 36 respectively for supporting at an associated transverse cross-member 38 or 40 respectively. The transverse cross-members 38, 40 can in particular be part of a bed base or bed frame or bed stead.

As can be seen in particular from FIG. 1B and FIG. 3, the support surfaces 34, 36 are arranged in accordance with the invention in longitudinal direction of the base body 4 at the level of the pivot axes 14, 16, such that in the mounting position of the double drive 2 at the transverse cross-members 38, 40 shown in the drawing, the pivot axes 14, 16 lie respectively in vertical direction via the respective support surface 34 or 36. The longitudinal direction of the base body is understood, according to the invention, to be the direction, in which the base body has the greatest extension.

FIG. 1A shows the double drive 2 in a starting position of the adjustment movement, in which the pivot levers 18, 20 are not adjusted relative to the base body 4 and pivotally adjustable support parts of a support device for supporting a cushioning span a substantially horizontal support plane via the pivot levers 18, 20.

FIG. 1B shows the double drive 2 in an end position of the adjustment movement, in which the pivot levers 18, 20 are pivoted to the maximum relative to the base body 4 and thus pivotally adjustable support parts of a support device are is pivotally adjusted to the maximum relative to each other via the pivot levers 18, 20.

FIG. 2 and, in particular, FIG. 3 show the structure of the drive units 6, 8 in more detail. For reasons of visualisation, the half-shell 28 of the drive housing 24 is omitted in FIG. 3. Only the drive unit 6 is explained in more detail below. The drive unit 8 is constructed correspondingly and is therefore not explained in more detail here.

The drive unit 6 comprises an electromotive drive unit 42, which is in rotation drive connection via a worm gear with a stationary spindle nut of a spindle drive 44, which is arranged at a threaded spindle 46 that is disposed so as to be non-rotatable and movable in its axial direction. The threaded spindle 46 forms the output member 10 of the drive unit 6 with a slider 48, which is placed at the end of the threaded spindle 46 facing the pivot axis 14.

Control and voltage supply means for controlling and supplying voltage to the drive units 6, 8 are omitted in the drawing for reasons of simplification. However, the structure of corresponding control and voltage supply means is generally known to the skilled person and is therefore not explained in more detail here.

One end of a plate 50, the other end of which is connected to the pivot lever 18 eccentrically to the pivot axis 14, is connected to the slider 48 pivotally around a pivot axis parallel to the pivot axis 14.

To pivotally adjust the pivot lever 18 from the starting position of the adjustment movement shown in FIG. 1A to the end position of the adjustment movement shown in FIG. 1B, the electric motor 42 drives the spindle nut of the spindle drive 44, so that the threaded spindle 46 as output member of the drive unit 6 moves to the end position shown in FIG. 2 and FIG. 3. During this movement, the slider 48 pulls at the plate 50, so that the pivot lever 18 is pivotally adjusted to the position shown in FIG. 2 and FIG. 3, which corresponds to the end position of the adjustment movement.

The return setting from the end position of the adjustment movement shown in FIG. 2 and FIG. 3 to the starting position of the adjustment movement shown in FIG. 1A takes place with the drive unit 6 switched on, but under the weight force of the pivot lever 18 and the weight force of an associated support part of the support device and, if necessary, additionally under the weight force of the weight of a person resting at the support device.

As can be seen from FIG. 3 and FIG. 4, the supporting and fixing structure 30 in the embodiment shown is formed as an angle piece 52 moulded at the longitudinal cross-member 22, one leg 54 of which forms the support surface 34 and the other leg 56 of which supports a fixing plate 58 (see FIG. 4) for fixing to the transverse cross-member 38.

As can be seen from FIG. 4, the base body 4 can be screwed to the transverse cross-member 38 via the fixing plate 58, so that in this manner the base body 4 is fixed to the transverse cross-member 38 via the supporting and fixing structure 30. The supporting and fixing structure 32 is correspondingly formed and is therefore not explained in more detail here.

It can be seen in particular from FIG. 3 that the pivot axis 14 lies via the transverse cross-member 38 in the mounting position of the double drive 2 shown in the drawing. The corresponding applies to the arrangement of the pivot axis 16 via the transverse cross-member 40. Due to this arrangement chosen according to the invention, reaction forces occurring during the adjustment are directly transferred into the transverse cross-members 38, 40. In this manner, bending loads on the base body 4 are reduced. With regard to the reduction of bending loads, the shortening of the base body 4 between the supporting and fixing structures 30 and 32, which is made possible by the invention, also has a positive effect.

The invention thus provides a double drive in a skilful manner, which is simple, inexpensive and robust.

FIG. 5 and FIG. 6 show a second embodiment of a double drive 2 according to the invention. The second embodiment differs from the first embodiment according to FIGS. 1 to 4 in that the longitudinal cross-member 22 of the base body 4, at which the pivot levers 18, 20 are arranged in the first embodiment, is omitted in the second embodiment. Instead, the drive housing 24 is extended for mounting the pivot levers 18, 20 and forms the base body 4. Angle pieces 60, 62 made of metal are connected to the ends of the drive housing 24, of which the angle piece 60 can be seen in more detail in FIG. 6. The angle piece 62 is correspondingly constructed and is not explained in more detail.

In a manner corresponding to the first embodiment, the angle piece 60 supports a fixing plate 66 at its one leg 64, via which the angle piece can be screwed to the transverse cross-member 38 for fixing the double drive 2 thereto. The other leg 68 is fixed to the drive housing 24. As can be seen in particular from FIG. 5, the pivot axis 14 lies in the mounting position of the double drive 2 via the transverse cross-member 38 according to the invention.

FIGS. 7 to 10 show a third embodiment of a double drive 2 according to the invention, which is used to adjust a support device 70. The support device 70 comprises a stationary buttock support part 72 screwed to the upper side of the drive housing 24, to which an upper body support part 76 is connected via a hinge 74 pivotally adjustably, which is pivotally adjustable via the pivot lever 20.

A leg support part 80 is pivotally adjustably connected to the end of the buttock support part 72 facing away from the upper body support part 76 via a further hinge 78, and a calf support part 84 is pivotally adjustably connected to the end thereof facing away from the buttock support part 72 via a further hinge 82. The leg support part 80 is pivotally adjustable together with the calf support part 84 via the pivot lever 18.

The third embodiment according to FIGS. 7 to 10 differs from the second embodiment according to 6 and 7 firstly in that the supporting and fixing structures 30, 32 are moulded at the drive housing 24, which is made of plastic.

Furthermore, the embodiments differ in that in the embodiment according to FIGS. 5 and 6 (as in the first embodiment according to FIG. 1 to FIG. 4) the drive units 6, 8 operate in tension, while in the embodiment according to FIGS. 7 to 10 the drive units 6, 8 operate in compression. While in the embodiment according to FIGS. 5 and 6 the force application point at the pivot lever 18, which is eccentric to the pivot axis 14, lies above the pivot axis 14, in the embodiment according to FIGS. 7 to 10 this force application point lies below the pivot axis 14, as can be seen, for example, from a comparison of FIG. 2 with FIG. 9 or FIG. 10.

On the basis of a starting position of the adjustment movement, the electric motor 42 drives the spindle drive 44 in such a way that the threaded spindle 10 as output member moves in direction to the pivot axis 14. Here, the slider 48 presses against the pivot lever 18 via the plate 50, so that the same is pivoted clockwise around the pivot axis 14 in the drawing, until the end position of the adjustment movement shown in FIG. 10 is reached.

LIST OF REFERENCE SIGNS

2 double drive
4 base body
6 drive unit
8 drive unit
10 output member
12 output member
14 pivot axis
16 pivot axis
18 pivot lever
20 pivot lever
22 longitudinal cross-member
24 drive housing
26 half shell
28 half shell
30 supporting and fixing structure
32 supporting and fixing structure
34 support surface
36 support surface
38 transverse cross-member
40 transverse cross-member
42 electric motor
44 spindle drive
46 threaded spindle
48 slider
50 plate
52 angle piece
54 leg
56 leg
58 fixing plate
60 angle piece
62 angle piece
64 leg
66 fixing plate
68 leg
70 support device
72 buttock support section
74 hinge
76 upper body support
78 further hinge
80 leg support section
82 further hinge
84 calf support section

The invention claimed is:

1. An electromotive double drive for adjusting, relative to one another, pivotally adjustable support parts of a support device to support a cushioning of a seating and/or lying furniture, the electromotive double drive comprising:

a base body, at which two drive units are arranged, each of which two drive units respectively includes an output member, two pivot levers, each of which two pivot levers are spaced apart from each other in a longitudinal direction of the base body and are each pivotably disposed at the base body around a pivot axis, wherein the two pivot levers are respectively operatively connected to the output member of an associated one of the drive units to pivot the pivot levers relative to the base body, the base body includes two supporting and fixing structures spaced apart from each other in a longitudinal direction of the base body to support and fix the base body at transverse cross-members, wherein each supporting and fixing structure includes a support surface to rest at one of the transverse cross-members, and each of the support surfaces is arranged, in a longitudinal direction of the base body, at a location of a respective one of the pivot axes in such a way that, in a mounting position of the double drive, the pivot axes lie offset in a vertical direction above a respective associated support surface.

2. The double drive according to claim 1, wherein: the base body includes a longitudinal cross-member to which at least one drive housing to accommodate at least one of the drive units is fixed and at which the pivot levers are pivotably disposed.

3. The double drive according to claim 2, wherein: the drive housing is made of plastic.

4. The double drive according to claim 2, wherein: the longitudinal cross-member is made of metal.

5. The double drive according to claim 1, wherein: the drive units are accommodated in a common drive housing.

6. The double drive according to claim 1, wherein: at least one of the supporting and fixing structures is formed as an angle piece including two legs, one of the two legs forming the support surface and another leg of the two legs forming or supporting a fixing plate to be fixed to the transverse cross-member.

7. The double drive according to claim 6, wherein: the angle piece is formed as a metal part.

8. The double drive according to claim 1, wherein: at least one of the supporting and fixing structures is molded to the base body.

9. An electromotively adjustable support device for supporting a cushioning of a seating and/or lying furniture, with support parts, which are pivotally adjustable relative to one another to support the cushioning, wherein the support device is provided with the electromotive double drive of claim 1.

10. A seating and/or lying furniture, including the electromotively adjustable support device of claim 9.

* * * * *